US005346218A

United States Patent [19]

Wyte

[11] Patent Number: 5,346,218

[45] Date of Patent: Sep. 13, 1994

[54] METAL WOOD GOLF CLUB WITH PERMANENTLY ATTACHED INTERNAL GATES

[75] Inventor: Michael Wyte, Culver City, Calif.

[73] Assignee: Wilson Sporting Goods Co., Chicago, Ill.

[21] Appl. No.: 127,813

[22] Filed: Sep. 28, 1993

[51] Int. Cl.[5] ..... A63B 53/04; B22C 9/04

[52] U.S. Cl. ..... 273/167 R; 273/167 H; 164/34; 164/45; 164/363; 164/369

[58] Field of Search ..... 273/167 R, 167 H, 167 F, 273/169, 171, 172, 173, 77 R, 78, 80.1, 80.2; 164/34, 35, 44, 45, 246, 249, 235, 361, 363, 369, 410; 249/61, 62

[56] References Cited

U.S. PATENT DOCUMENTS 1,167,106 1/1916 Palmer ..... 273/171
3,863,706 2/1975 Chandley ..... 273/167 R X
4,472,092 9/1984 Schmidt ..... 273/167 R
4,511,145 4/1985 Schmidt ..... 273/167 H
4,651,799 3/1987 Chandley .
4,681,321 7/1987 Chen ..... 273/167 H
4,930,781 6/1990 Allen ..... 273/78 X
5,056,705 10/1991 Wakita ..... 273/167 H
5,141,230 8/1992 Antonious .
5,180,166 1/1993 Schmidt .

*Primary Examiner*—Theatrice Brown
*Assistant Examiner*—Sebastiano Passaniti

[57] ABSTRACT

A metal wood golf clubhead is formed from a mold which includes an external gate into which molten metal is poured and internal gates in the mold cavity which facilitate flow of the molten metal into all portions of the mold cavity. The internal gates are located in the portion of the mold cavity which forms the interior surface of the top of the clubhead.

5 Claims, 3 Drawing Sheets

METAL WOOD GOLF CLUB WITH PERMANENTLY ATTACHED INTERNAL GATES

BACKGROUND

This invention relates to metal wood golf clubs, and, more particularly, to a metal wood golf club which includes a permanently attached internal gate.

Metal wood golf clubheads are conventionally formed by investment casting using the lost wax process. A wax impression of the hollow clubhead is made, and a mold is formed around the was impression. The wax is melted and removed to form a mold cavity in the mold. The wax impression includes a gate portion which forms a gate or passage in the mold which connects the mold cavity to the exterior of the mold. The gate is usually located at the toe or heel portion of the clubhead.

Molten metal is poured into the gate of the mold and flows into the mold cavity. After the metal cools to form the clubhead, the mold is broken up and cleaned away from the clubhead. The solid metal which occupied the gate portion is removed from the clubhead, and the gate area is ground and buffed to provide a smooth exterior surface.

The size of metal wood clubheads has increased in recent years, and larger clubheads often require additional external gates on the crown or top of the clubhead and/or the skirt or sides of the clubhead in addition to the main external gate to facilitate flow of molten metal throughout the mold cavity, to improve casting, and to reduce surface porosity on the molded clubhead. The external gates require additional processing steps and additional material and form molded metal material which must be removed from the cast clubhead.

SUMMARY OF THE INVENTION

The invention utilizes internal gates in the mold which form gate material on the interior surfaces of the molded clubhead. The interior gate material does not need to be removed from the clubhead and remains as a permanent part of the clubhead. The internal gates provide the following benefits:

1. No need to construct separate gate molds.
2. No need to wax inject separate gate runners.
3. No need to wax assemble the gate runners to the wax pattern.
4. A reduction in the total quantity of wax used.
5. Increased wax set-up throughput by reducing individual mold assemble time.
6. A reduction in the total quantity of shell material used.
7. A reduction in the total quantity of metal poured for each head.
8. Elimination of multiple gate cut-off points.
9. Elimination of the need to grind the additional gate areas.
10. Provides a more uniform external surface and reduces the need for heavy belting of the external surface.
11. Reduces the total quantity of grinding belts used.

DESCRIPTION OF THE DRAWING

The invention will be explained in conjunction with an illustrative embodiment shown in the accompanying drawing, in which:

FIG. 8 is a front elevational view of the molded metal clubhead after the external gate is removed;

FIG. 9 is a sectional view taken along the line 9—9 of FIG. 8;

FIG. 10 is a front elevational view of a molded metal clubhead with an external gate on the toe portion of the clubhead; and FIG. 11 is a sectional view taken along the line 11—11 of FIG. 10.

DESCRIPTION OF SPECIFIC EMBODIMENTS

Figure 1:
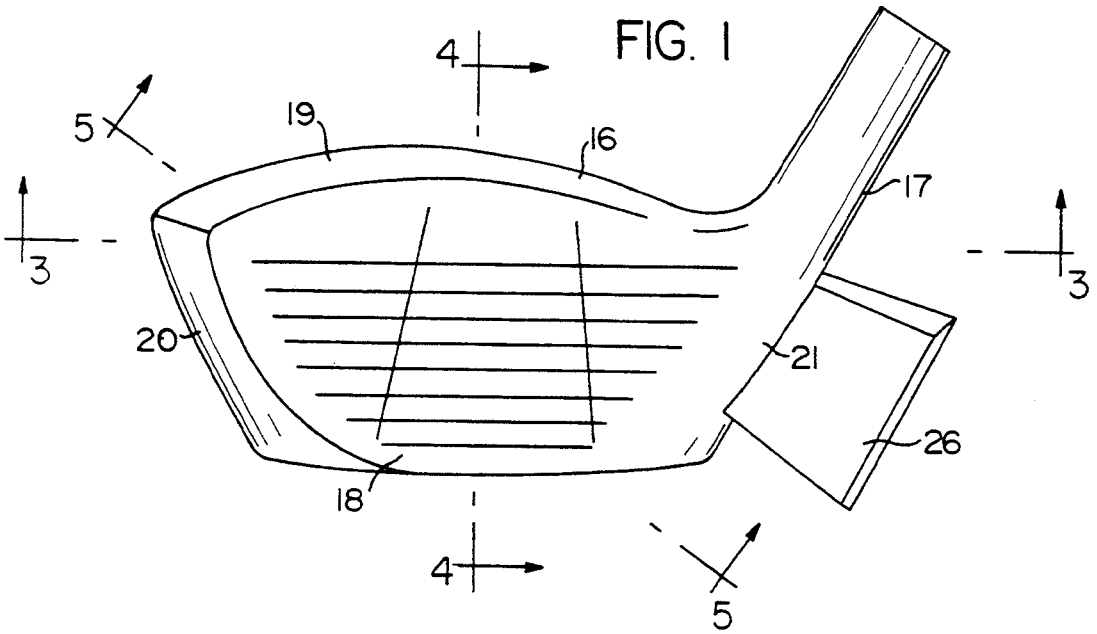
FIG. 1 is a front elevational view of a wax impression which is formed in accordance with the invention.
Figure 2:
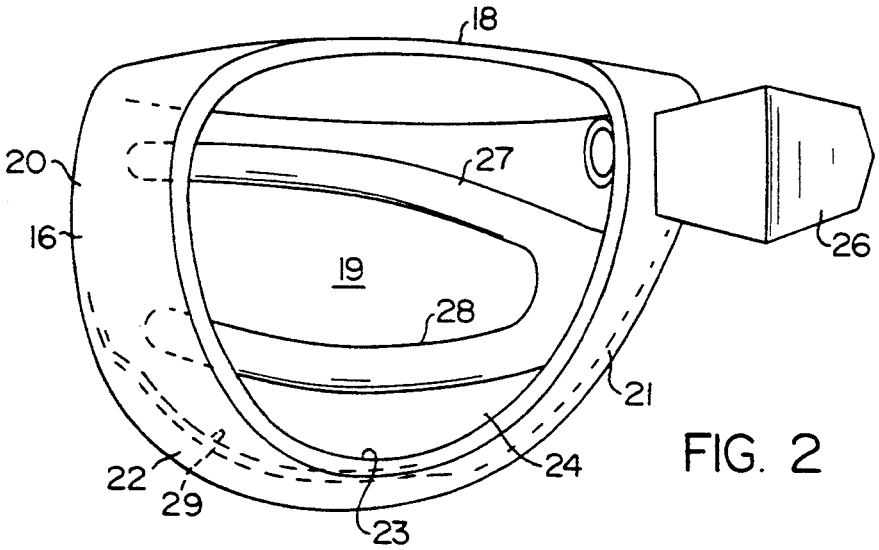
FIG. 2 is a bottom plan view of the wax impression of FIG. 1.
Figure 3:
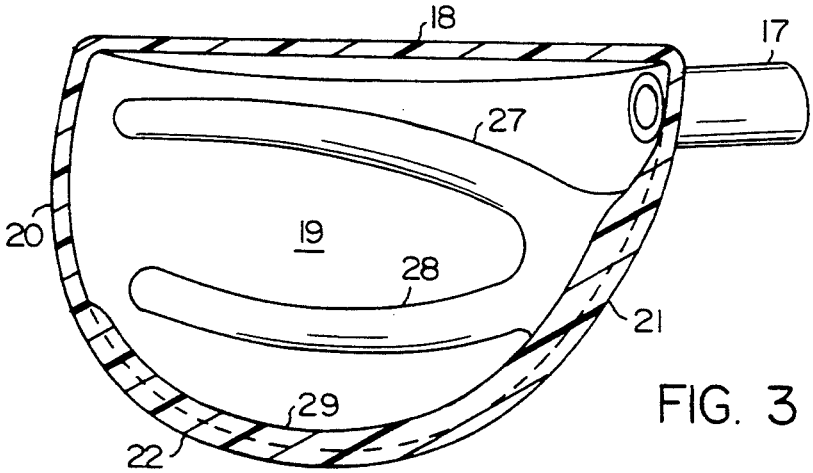
FIG. 3 is a sectional view taken along the line 3—3 of FIG. 1.
Figure 4:
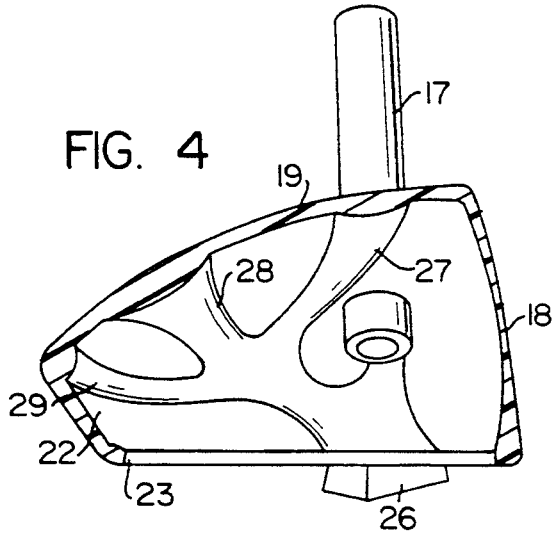
FIG. 4 is a sectional view taken along the line 4—4 of FIG. 1.
Figure 5:
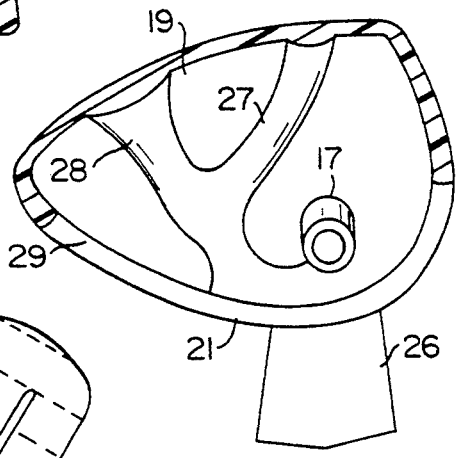
FIG. 5 is a fragmentary bottom view as would be seen along the line 5—5 of FIG. 1.

FIGS. 1–5 illustrate a wax impression 15 for making a metal wood golf clubhead. The wax impression is molded in the shape of the clubhead which will ultimately be formed by investment casting. The wax impression includes a body 16 and a hosel 17. The body includes a face wall 18, a top wall 19, a toe wall 20, a heel wall 21, and a side wall 22. The side wall extends between the toe wall and the heel wall below the top wall. The body of the wax impression 15 is hollow, and the body has a bottom opening 23 (FIG. 3) and an interior chamber or cavity 24.

An external main gate 26 extends outwardly from the heel wall in the area where the heel wall merges with the hosel. Internal gates 27, 28, and 29 are located on the interior surfaces of the heel wall, the side wall, and the top wall. Each of the internal gates is formed by a rib or projection which will form a groove in the ceramic mold material which is later formed over the interior and exterior surfaces of the impression.

The internal gate 27 extends from the interior of the heel wall opposite the main gate 26, upwardly along the interior surface of the side wall 22, and along the front portion of the top wall 19. The internal gate 28 extends from opposite the main gate 26, upwardly along the side wall 22, and along the midportion of the top wall 19. The internal gate 29 extends from opposite the main gate 26, upwardly along the side wall 22, and along the top wall adjacent the side wall.

Figure 6:
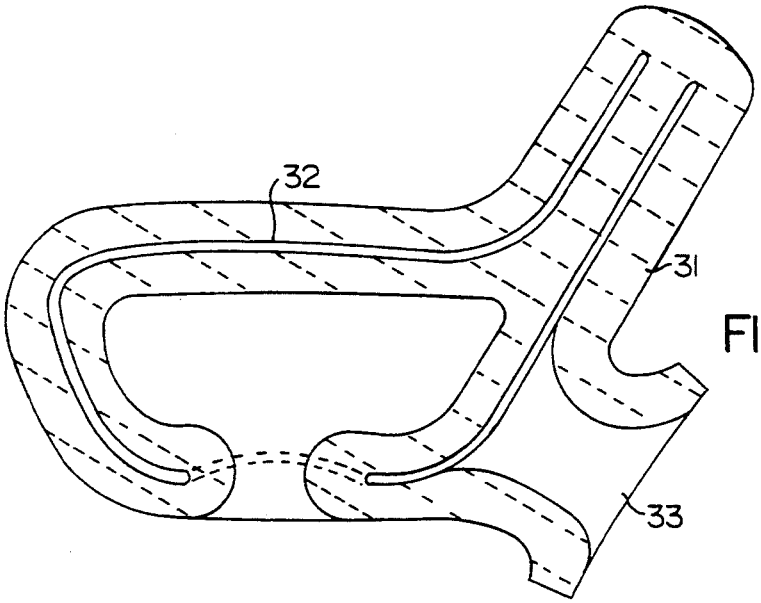
FIG. 6 is a sectional view of the mold which is prepared from the wax impression.

FIG. 6 illustrates a ceramic mold 31 which is formed by packing conventional ceramic mold material over the interior and exterior surfaces of the wax impression 15 and then heating the ceramic material to fuse the material and to melt the wax. The melted wax runs out of the mold and leaves a mold cavity 32 which is the negative of the wax impression. The technique for forming the wax impression and the ceramic mold are conventional and well known except for the use of the internal gates, and the details of the techniques need not be described herein.

The cavity 32 of the ceramic mold 31 is formed with an external main gate or passage 33 which is formed by the main gate 26 of the wax impression and internal gates or passages which are formed by the internal gates 27–29 of the wax impression and which communicate with the external gate 33. Molten metal is poured into the external gate 33 and flows throughout the cavity 32, including the internal gates of the cavity. The internal gates are internal extensions of the main gate and facilitate flow of the molten metal throughout the mold cavity.

Figure 7:
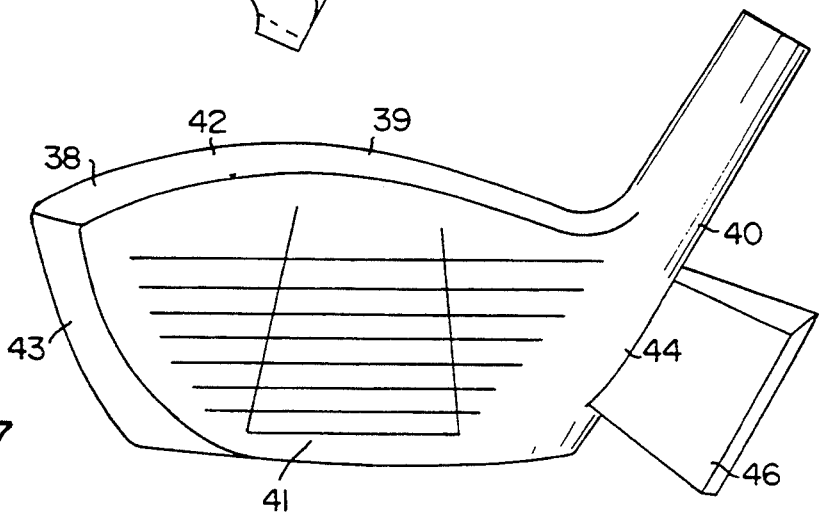
FIG. 7 is a front elevational view of a molded metal wood clubhead after removal from the mold.

After the molten metal cools and hardens to form the cast clubhead, the ceramic mold material is broken away from the clubhead in the conventional manner. FIG. 7 illustrates the cast metal clubhead 38 after the mold material is removed. The metal clubhead 38 has the same shape as the wax impression 15 and includes a body 39, a hosel 40, a face wall 41, a top wall 42, a toe wall 43, a heel wall 44, and a side wall 45 (FIG. 9). An external main gate or projection 46 is formed by the main gate 33 of the ceramic mold 31, and internal gates or ribs 47, 48, and 49 (FIG. 9) are formed by the internal gates of the mold 31. A bottom opening 50 permits removal of mold material from inside of the clubhead. The bottom opening is later closed by a conventional soleplate which is welded to the body.

During conventional finishing operations of the metal clubhead, the external projection on gate 46 is removed from the clubhead and the external surface of the main gate area on the clubhead is ground and buffed to provide a smooth surface as shown in FIG. 8. However, the internal gates or ribs 47–49 are not visible and are not removed. The internal gates therefore do not require any finishing operations.

FIGS. 10 and 11 illustrate a wax impression 51 which is similar to the wax impression 15, but a main external gate 52 is located on the toe wall 53 rather than the heel wall 54. Internal gates 55, 56, and 57 extend from the interior surface of the toe wall opposite the external gate 52 upwardly along the toe wall and then along the interior surface of the top wall 58.

The wax impression 51 is utilized in the same manner as the wax impression 15 to form a ceramic mold with a mold cavity having internal gates. The ceramic mold is then used to mold or cast a metal clubhead having the same shape as the wax impression 51. Thereafter, the external main gate corresponding to the gate 52 is removed but the internal gates corresponding to the gates 55–57 are not removed.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A cast metal wood clubhead having a face wall, a toe wall, a heel wall, a top wall, and a side wall extending from the toe wall to the heel wall below the top wall, each of said walls having exterior and interior surfaces to provide said clubhead with an interior chamber, a portion of said toe wall or heel wall providing a gate area, at least one internal gate extending from said gate area to the interior surface of the top wall and extending along the interior surface of the top wall.

2. The clubhead of claim 1 including a plurality of said internal gates, one of the internal gates extending along the top wall near the side wall, another internal gate extending along the top wall between the side wall and the face wall.

3. The clubhead of claim 1 in which said gate area is on the heel wall, said internal gate extending from said gate area along the heel wall and along the side wall to the top wall.

4. The clubhead of claim 1 in which said gate area is on the toe wall, said internal wall extending from said gate area along the toe wall to the top wall.

5. A method of casting a metal wood clubhead comprising the steps of:

forming a wax impression of the clubhead, the wax impression including a face wall, a toe wall, a heel wall, a top wall, a side wall extending from the toe wall to the heel wall below the top wall, an external gate portion extending outwardly from either the toe wall or the heel wall, each of said walls having exterior and interior surfaces to provide said wax impression with an interior chamber, and at least one internal gate extending from the interior surface of the wall on which the external gate is located to the interior surface of the top wall and extending along the interior surface of the top wall, forming a mold over the exterior and interior surfaces of the wax impression, melting the wax to provide a mold cavity in the mold, the mold cavity having an external gate passage formed by the external gate of the wax impression and at least one internal gate groove provided by the internal gate of the wax impression, pouring molten metal into the external gate passage of the mold so that the molten metal flows into the mold cavity and the internal gate groove, allowing the metal to cool to form a metal clubhead having an external gate portion and an internal gate portion, removing the mold from the clubhead, and removing the external gate portion from the clubhead but not the internal gate portion.

* * * * *